United States Patent [19]

Rios

[11] 4,453,149

[45] Jun. 5, 1984

[54] EXCITATION LEAD FOR SUPERCONDUCTING DEVICES, PARTICULARLY MAGNETS

[75] Inventor: Pedro A. Rios, Schenectady, N.Y.

[73] Assignee: General Electric Company, Schenectady, N.Y.

[21] Appl. No.: 481,190

[22] Filed: Apr. 1, 1983

[51] Int. Cl.[3] ..... H01F 7/22

[52] U.S. Cl. ..... 335/216; 174/15 BH; 174/15 CA

[58] Field of Search ..... 174/9 R, 15 CA, 15 BH, 174/16 BH; 335/216

[56] References Cited

U.S. PATENT DOCUMENTS

| | | | |
|---|---|---|---|
| 1,878,094 | 9/1932 | Atkinson | 174/15 BH |
| 3,916,079 | 10/1975 | Kohler et al. | 174/15 BH |
| 4,369,636 | 1/1983 | Purcell et al. | 335/216 X |
| 4,394,634 | 7/1983 | Vansant | 335/216 |

*Primary Examiner*—J. V. Truhe
*Assistant Examiner*—Morris H. Nimmo
*Attorney, Agent, or Firm*—Lawrence D. Cutter; James C. Davis, Jr.; Marvin Snyder

[57] ABSTRACT

When it is desired to change the magnetic field levels in a superconducting magnet, it is conventional practice to employ electrical leads. One end of the leads is maintained at cryogenic temperatures while the other is at ambient temperature. In some cases, it is desirable to remove the leads when they are not being used, in order to reduce thermal losses. In that case, it is conventional practice to make and break the contact at the cryogenic temperature. However, repeated make and break contacts with such lead can produce worn contact surfaces that eventually exhibit a higher resistance than is desired. This high resistance will give rise to heating of the cryogenic components. In order to alleviate this problem, an excitation lead system is provided which is removable from the cryostat. Furthermore, thermal insulation means are provided so that the external connection is relatively warm when the leads are connected, but is maintained at relatively cold temperatures during normal operation of the superconducting device. The fact that the contact is relatively warm when the lead is in use relaxes the requirement for a low resistance contact.

7 Claims, 2 Drawing Figures

EXCITATION LEAD FOR SUPERCONDUCTING DEVICES, PARTICULARLY MAGNETS

BACKGROUND OF THE DISCLOSURE

This invention is related to excitation leads for connection to a device such as a superconducting magnet. More particularly, the present invention is related to an excitation lead system which provides thermal isolation during normal magnet operation but yet provides a relatively warm contact surface for external connection of electrical leads which are employed when it is necessary to change the magnet field levels or to make field corrections.

In a superconducting device such as a coil of superconducting material which forms part of a magnet assembly, it is necessary to maintain the superconducting material at sufficiently low temperatures. For the present at least, materials which exhibit superconducting properties at room temperature are not known to be available. In order to maintain the superconducting material at the proper cryogenic temperatures, a housing known as a cryostat is employed to provide the desired amount of thermal insulation between the cryogenically cooled superconducting material and ambient conditions. The cryostat employed to achieve this thermal isolation typically includes an inner vessel defined by a set of internal walls and an external vessel defined by a set of external walls, the volume between the two vessels being maintained under vacuum. The interior volume of the cryostat is filled to the desired level with a coolant medium, such as liquid helium, so as to maintain the electrical device contained within the internal cryostat volume at a temperature suitable to maintain the coils in the superconducting state.

An application for superconducting magnets is nuclear magnetic resonance. One of the objects of nuclear magnetic resonance is to provide images of internal body organs without the necessity of exposing the patient to ionizing radiation. Another object is to perform spectroscopy, in vivo. In short, NMR appears to be able to provide physicians and medical technicians with valuable diagnostic information in a manner which is totally non-invasive. In order to increase the resolution of the resultant NMR signals and in order to compensate for the inherently weak nature of the resultant NMR signals, it is highly desirable to place the patient or object being studied in a highly uniform magnetic field which is also a high strength magnetic field. In particular, it has been found that it is generally desirable that this field have a magnetic field strength of between about 0.1 and about 2.0 tesla, or more. There are in general two means for providing such a strong magnetic field. One may employ conventional resistive type magnets in which a large amount of electrical power is consumed because of the high current levels required and the finite or non-zero resistance of the wire. Alternatively, and in keeping with the objects of the present invention, it is also possible to employ a superconducting magnet. In such a device, a coil of superconducting material is maintained inside a cryostat filled with a coolant, such as liquid helium. The choice of superconducting material and coolant employed must of course be compatible so that the material is in fact maintained in a superconducting state when maintained at the temperature of the liquid coolant. Because of the nature of superconducting materials, it is not only possible to create large levels of current flow within these materials, but it is also possible and usually desirable to operate the superconducting magnet or device in what is called the "persistent mode". In this mode, a current is injected into the superconducting coil or the material through which it is caused to flow. The coil terminals are shorted, the driving excitation is then removed and the superconducting nature of the material permits the current that has been established to flow indefinitely. Accordingly, this is described as the persistent mode of operation.

However, it sometimes becomes necessary to change the level of the magnetic field produced by the circulating current. It is also sometimes necessary to change the current in the field in the coil to make corrections in the magnetic field distribution, particularly when the magnet or device has been operating over an extended period of time. When it is necessary to change the level of current circulating within the superconducting material it becomes necessary to connect the coil or device to external leads. It is to these leads that the present invention is directed.

While it is possible to operate superconducting magnets in a fashion in which the external leads are always in contact with an external current source, this is nonetheless undesirable because of thermal losses which can result. In particular, if the coil excitation is maintained by current flowing through the leads, then current flowing in the leads, which are not maintained in a superconducting state, produces a resistive (or $I^2R$) heating in these leads. This electrical heating of the external portion of the lead that bridges the interface region between the liquid coolant and ambient temperature can easily result in heating and boiling off of the liquid coolant. If the coils are shorted so that current is not flowing through the leads, but the leads are left in place so as to experience the temperature range between ambient temperature and the cryogenic coolant for the coil, conduction of heat from ambient through the lead can also cause boiling of the liquid coolant. Conventionally, it is found that this heating does in fact cause boiling of the liquid helium coolant thereby producing loss of this expensive coolant. Accordingly, for these reasons it is desirable to construct excitation leads which are repeatedly removable so that this form of coolant heating occurs only during those times which the leads must be used to change the magnetic field. Furthermore, it is seen that a form of connection is desired in which many make and break contact cycles can be made.

For this kind of persistent mode of superconducting magnet operation, the present practice employs an electrical contact interface or joint which is maintained at the liquid coolant temperature. Since heat generated by electrical power loss in contact resistance passes into the liquid coolant medium, it is imperative that the electrical resistance of this joint be extremely low. In testing such joints, it has been found that contact surfaces coated with indium may be employed to attain such low joint resistance. However, indium exhibits a tendency to wear following repeated make and break contact cycles. This wear is caused by the mating part, which is deliberately designed to be harder than the lead and particularly sharp in order to ensure that a low resistance joint can be made in spite of possible water or solid-air frost formation on the cold mating surface. Furthermore, the mating surface of the lead that is maintained at the liquid helium temperature may not be repairable unless the entire cryostat is drained and warmed up to ambient temperature. This is a significant process because it is both time consuming and expensive. It would be particularly undesirable to have to go through this process for superconducting magnets employed in NMR. Accordingly, it would be desirable to be able to employ an excitation lead system for a superconducting magnet operating in the persistent mode which overcomes these operational difficulties.

SUMMARY OF THE INVENTION

In accordance with a preferred embodiment of the present invention an excitation lead system comprises an electrical conductor such as a rod or shaft extending between the inner and outer walls of the cryostat together with a housing surrounding the portion of the rod between the inner and outer cryostat walls, and with a removable dewar having a re-entrant cavity which defines a coolant vapor flow path extending along the external portion of the rod toward the inner cryostat wall and thence again in an outward direction between the dewar wall and the housing wall so as to provide a long thermal path between the interior of the cryostat and the external ambient environment. The excitation lead system for the present invention also includes a removable external cap which covers an opening in the external cryostat wall through which electrical connection may be made with the rod; this cap includes a vent aperture which is in fluid communication with the coolant vapor path.

In this way, during persistent mode operation, the excitation lead is maintained at a relatively cold temperature slightly above the cryogenic temperatures maintained within the interior of the cryostat itself. Thermal losses are restricted to conduction through a long path, or through the evacuated dewar space. However, the lead system of the present invention provides an electrical connection or joint that is disposed in the warm ambient environment during lead operation. By configuring the excitation lead in this way the necessity for the previously required extremely low resistivity connection is obviated by the fact that the joint is not in close proximity to the liquid coolant. In accordance with another embodiment of the present invention there is also provided a removable replacement cap similar to the aforementioned cap with the replacement cap being provided with an electrical conductor disposed therein for making contact with the excitation lead while still being able to prevent excess coolant leakage.

Accordingly, it is an object of the present invention is provide an external excitation lead system for superconducting magnets and like devices.

It is a further object of the present invention to eliminate the necessity of maintaining excitation lead joints at the liquid coolant temperature.

It is also an object of the present invention to provide an excitation lead system which is capable of repeated make and break contacts.

It is also an object of the present invention to reduce or eliminate the necessity of repairing damage done to excitation leads employed in superconducting magnet systems, particularly those used in NMR systems.

DESCRIPTION OF THE FIGURES

The subject matter which is regarded as the invention is particularly pointed out and distinctly claimed in the concluding portion of the specification. The invention, however, both as to organization and method of practice together with further objects and advantages thereof, may best be understood by reference to the following description taken in connection with the accompanying drawings in which:

DETAILED DESCRIPTION OF THE INVENTION

Figure 1:
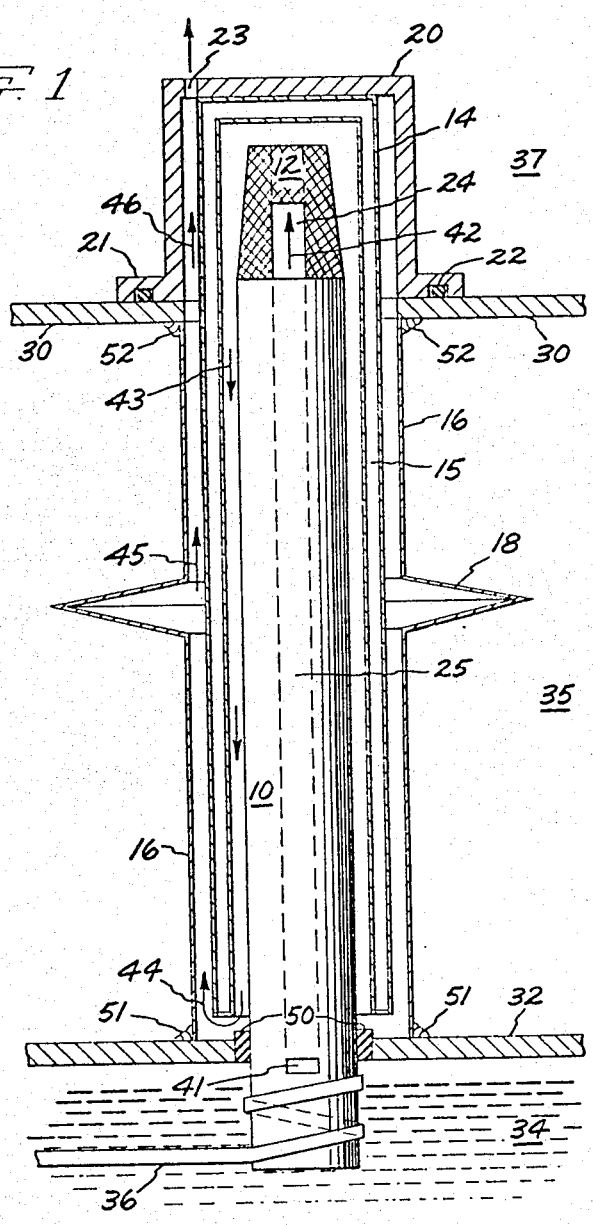
FIG. 1 is a partial cross-sectional side elevation view of an excitation lead system in accordance with the present invention.

FIG. 1 illustrates an excitation lead system in accordance with the present invention. In particular, there is shown inner cryostat wall 32 which surrounds liquid coolant medium 34. This coolant medium is typically liquid helium. Also, shown is exterior cryostat wall 30 which opens to ambient 37. Between internal cryostat wall 32 and external cryostat wall 30 there is defined volume 35 which is preferably evacuated so as to provide thermal insulation between inner cryostat wall 32 and outer crysotat wall 30. Electrically conducting rod 10 is disposed at least partially through inner cryostat wall 32 and is connected to superconducting material 36, which may be in the form of a ribbon or wire, typically through the use of special alloy solders which are employed for this purpose and are well known to those skilled in the art. Superconductor 36 is connected to apparatus within the interior of the cryostat, such as a magnet coil (not shown). In order to provide a liquid- and gas-tight seal for the inner cryostat vessel, rod 10 is preferably attached to inner cryostat wall 32, by a liquid- and gas-impermeable electrical insulator 50. Rod 10 extends outward from inner wall 32 toward an opening in outer wall 30 through which electrical connection may ultimately be made with rod 10. Rod 10 also possesses a cooling vapor path 25 disposed therethrough so as to permit some flow of vaporized coolant therethrough. The vapor enters aperture 41 disposed in an end of rod 10 within inner cryostat wall 32. Entrance aperture 41 is in fluid communication with coolant flow channel 25 which extends through rod 10 in a longitudinal direction to exit aperture 24 in the upper portion of rod 10, that is, in that portion of rod 10 which is located proximate to exterior cryostat wall 30. Additionally, rod 10 preferably possesses a frusto-conical contact surface 12 which may be either roughened or knurled so as to ensure proper contact with a mating electrical conductor. It should be noted that while electrode lead 10 is illustrated in FIG. 1 as being a male connector, it is equally within the teachings of the present invention to employ a female connection termination in place of the male termination surface 12.

Another aspect of the present invention is housing 16 which surrounds rod 10 and which extends from interior cryostat wall 32 to exterior cryostat wall 30. Housing 16 is preferably sealed against interior cryostat wall 32 by welding, as is illustrated by weld joints 51. Additionally, housing 16 is preferably sealed against exterior cryostat wall 30, also by welding, as is illustrated by weld joints 52. Furthermore, housing 16 is disposed around an aperture in cryostat wall 30 through which access may be had to rod 10, and in particular access to contact surface 12. While rod 10 is shown in its preferable position in FIG. 1 protruding through this access aperture in wall 30, it is not required that rod 10 extend for such a length. However, it is nonetheless desired to provide convenient access to contact surface 12 from the exterior of the cryostat. Housing 16 also preferably possesses bellows joint 18 which acts to compensate for thermal and cryogenic contraction and expansion. Housing 16 preferably comprises a thin wall material of low thermal conductivity, such as stainless steel having a thickness of about 10 mils.

Another element of the present invention is dewar 14. Dewar 14 preferably has an interior volume 15 which is evacuated so as to provide thermal insulation in a direction transverse to the dewar walls. Dewar 14 also preferably is configured so as to exhibit a reentrant cavity into which rod 10 extends. Dewar 14 is further disposed with respect to housing 16 so as to define a coolant vapor flow path extending from channel exit 24 in a general direction from said exterior cryostat wall toward said interior cryostat wall in the volume defined between rod 10 and the inner dewar wall. This flow direction is generally indicated by flow arrow 43. The flow in this passage can be modified by the addition of baffles (not shown) to improve the heat transfer and further reduce thermal conduction along the walls of dewar 14. Dewar 14 is not sealed against inner cryostat wall 32 but rather permits coolant vapor flow between said dewar and said cryostat wall 32, as is generally indicated by flow arrow 44. Dewar 14 is also disposed with respect to housing 16 so as to define a coolant vapor flow path between the inner wall of housing 16 and the outer wall of dewar 14, as is generally indicated by flow arrows 45 and 46. The function of dewar 14 is to provide a long thermal distance for the coolant vapor to traverse. Thus thermal losses can be made to be extremely small because the metal experiencing the temperature gradient from ambient to cryogenic can be manufactured from thin-wall, low conductivity material such as stainless steel and the vapor being vented intercepts the heat reaching the low temperature region as it exchanges heat with the metal. This is true not only for dewar 14 but also for housing 16.

Another element of the present invention is cap 20 to which dewar 14 is preferably affixed. Cap 20 possesses flange 21 and o-ring seal 22 so as to provide a gas-tight seal against exterior cryostat wall 30. Cap 20 is fastened to wall 30 by any convenient means (not shown). Such means may include clamps, snaps, or bolts. However, if bolts are employed, then bolt holes in the wall 30 are preferably blind holes so as to preserve the insulating vacuum conditions in volume 35. Screw and thread means may also be employed to provide the desired effective seal of flange 21 against wall 30. The details of this fastening are not central to understanding or practicing the present invention. Cap 20 preferably comprises a low thermal conductivity material such as stainless steel. Cap 20 also possesses vent opening 23 which is in fluid communication with the above-described circuitous coolant vapor flow path. Accordingly, it is through vent aperture 23 that helium vapor, for example, is vented. However, by choosing vent opening 23 to have a proper orifice diameter or by employing a valve in this aperture, thermal losses can be minimized. While dewar 14 may be supported in its desired orientation by any convenient means, it is convenient and easy to affix dewar 14 to cap 20, such as is shown in FIG. 1. In this fashion then, cap 20 and dewar 14 may be simultaneously removed in preparation for the attachment of a mating electrical conductor to electrical contact surface 12.

Figure 2:
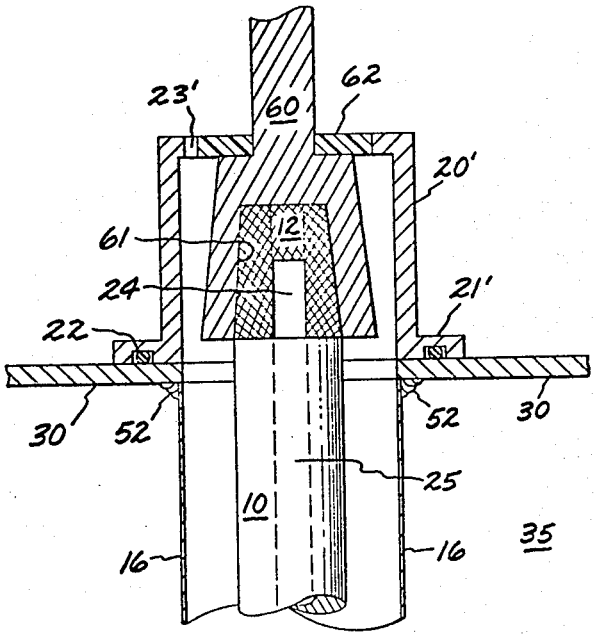
FIG. 2 is a partial cross-sectional side elevation view of part of the apparatus in FIG. 1 in which the cap has been replaced by a replacement cap including a mating electrical conductor.

Such a mating conductor is shown in FIG. 2. More particularly, FIG. 2 illustrates a replacement cap 20' with flange 21' and vent opening 23' which is used to replace cap 20 in FIG. 1 during field adjustment operations. The structures of the original cap 20 and the replacement cap 20' are preferably similar, except that replacement cap 20' has disposed therethrough electrical conductor 60 for injection of correction currents into superconducting material 36. As shown in FIG. 2, electrical conductor 60 possesses a female mating contact surface 61 which is preferably frusto-conical in shape so as to match surface 12 on rod 10. Furthermore, insulation disk 62 provides electrical insulation between conductor 60 and cap 20'.

The construction configuration of the excitation lead system shown in FIGS. 1 and 2 provides several advantages. In particular, since contact surface 12 is not maintained at cryogenic temperatures, the resistivity of the electrical connection is no longer as critical as in prior art designs. In particular, resistivity problems at the connection interface, particularly those caused by frost or solid-air formation are either no longer present or not critical. Even if some resistive heating does occur at the interface, the heating location is sufficiently distant from the inner cryostat vessel so as not to cause significant heating of coolant 34. Furthermore, the present invention provides a means for rapid connection and disconnection of the electrical excitation source. Additionally, many make and break cycles may be employed without concern for the condition of the contact surface since this surface is now highly accessible and shutdown of the cryostat is not required to effect maintenance or repair of this surface. Furthermore, valves or orifices in apertures 23 and 23' minimize the loss of any coolant vapor while nonetheless providing a coolant vapor flow path which is thermally long so as to provide significant and effective thermal insulation between the inner and outer portions of the cryostat.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. An excitation lead system in combination with a superconducting coil disposed within a cryostat having at least an internal wall and an external wall, comprising:

an electrical conductor extending through said cryostat walls and electrically insulated therefrom and electrically connected within said cryostat to said superconducting coil, said conductor having disposed therein an internal, longitudinally extending channel for passage of coolant vapors from the internal volume of said cryostat;

a housing surrounding the portion of said conductor extending between said internal and said external cryostat walls;

a removable dewar having a re-entrant cavity defined therein and disposed so that said conductor extends into said cavity and disposed so as to define a coolant vapor path extending from the external opening of said conductor channel along the exterior length of said conductor toward said internal cryostat wall and thence again toward the external cryostat wall along a path between the outermost wall of said dewar and the internal wall of said housing; and a removable external cap sealably covering an opening in said external cryostat wall through which electrical connection may be made with said conductor, said cap including a vent aperture in fluid communication with said coolant vapor path.

2. The combination of claim 1 in which said housing includes a bellows section so as to compensate for expansion and contraction.

3. The combination of claim 1 in which said electrically conductor possesses a roughened contact surface at the end closest to said external wall.

4. The combination of claim 1 in which said electrically conductor possesses a frusto-conical contact surface at the end closest to said external wall.

5. The combination of claim 1 in which said housing comprises stainless steel.

6. The combination of claim 1 in which said dewar is affixed to and supported by said removable cap.

7. The lead system of claim 1 wherein said removable external cap includes an external electrical conductor disposed therethrough and configured so as to mate with a contact surface on said electrically conductor, said external cap being configured so as to sealably mate with said external cryostat wall and including therein a vent aperture for fluid communication with coolant vapor path, said electrical conductor disposed through said external cap being thermally and electrically insulated therefrom.

* * * * *